US008644749B2

(12) United States Patent
Choi et al.

(10) Patent No.: US 8,644,749 B2
(45) Date of Patent: Feb. 4, 2014

(54) SURFACE HEATING TYPE HEATING UNIT FOR FIXING DEVICE, AND FIXING DEVICE AND IMAGE FORMING APPARATUS INCLUDING THE SAME

(75) Inventors: Jin-seung Choi, Suwon-si (KR); Youn-gun Jung, Yongin-si (KR); O-hyun Beak, Seoul (KR); Soo-hwan Bae, Seoul (KR); Young-hoon Han, Suwon-si (KR); Su-in Lee, Seongnam-si (KR); Eun-bong Han, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 197 days.

(21) Appl. No.: 13/200,921

(22) Filed: Oct. 5, 2011

(65) Prior Publication Data

US 2012/0087692 A1 Apr. 12, 2012

(30) Foreign Application Priority Data

Oct. 8, 2010 (KR) ..... 10-2010-0098411
Jan. 24, 2011 (KR) ..... 10-2011-0006813

(51) Int. Cl.
*G03G 15/00* (2006.01)
*G03G 15/20* (2006.01)

(52) U.S. Cl.
USPC ..... 399/330; 399/90

(58) Field of Classification Search
USPC ..... 399/90, 328, 329, 330, 333; 219/216, 219/541
See application file for complete search history.

(56) References Cited

U.S. PATENT DOCUMENTS

| | | | | | |
|---|---|---|---|---|---|
| 3,067,310 | A | * | 12/1962 | Walz et al. | 219/541 |
| 4,542,285 | A | * | 9/1985 | Grise | 219/543 |
| 4,690,872 | A | * | 9/1987 | Kato et al. | 428/446 |
| 4,755,659 | A | * | 7/1988 | Leon et al. | 219/547 |
| 5,229,582 | A | * | 7/1993 | Graham | 219/541 |
| 5,288,973 | A | * | 2/1994 | Ota et al. | 219/216 |
| 5,354,969 | A | * | 10/1994 | Akiyama et al. | 219/541 |
| 5,506,667 | A | | 4/1996 | Kinoshita | |
| 5,729,814 | A | | 3/1998 | Suzuki et al. | |
| 5,753,889 | A | * | 5/1998 | Kondo et al. | 219/216 |

(Continued)

FOREIGN PATENT DOCUMENTS

| | | |
|---|---|---|
| EP | 1927902 A1 | 6/2008 |
| JP | 3308116 | 5/2002 |
| JP | 2007-233405 | 9/2007 |

OTHER PUBLICATIONS

European Search Report dated Dec. 22, 2011 issued in corresponding European Patent Application No. 11184106.0.

(Continued)

*Primary Examiner* — Robert Beatty
(74) *Attorney, Agent, or Firm* — Staas & Halsey LLP

(57) ABSTRACT

A surface heating type heating unit for a fixing device, and a fixing device and an image forming apparatus including the same. The surface heating type heating unit includes a planar heating element on an outer circumferential surface of a supporter having cylindrical shape, a power feeding terminal at each end of the supporter, and a connector disposed between the planar heating element and the power feeding terminal. The connector is formed on a first region on the power feeding terminal, and includes an adhesive material for adhering the planar heating element and the power feeding terminal, and a conductive material formed on a second region of the power feeding terminal excluding the first region.

23 Claims, 10 Drawing Sheets

(56) References Cited

U.S. PATENT DOCUMENTS

| | | | | |
|---|---|---|---|---|
| 5,932,125 | A | 8/1999 | Kawata et al. | |
| 5,958,269 | A | 9/1999 | Suzuki et al. | |
| 6,101,363 | A | 8/2000 | Tomatsu | |
| 6,223,017 | B1 | 4/2001 | Akutsu et al. | |
| 6,594,455 | B2 * | 7/2003 | Lee | 399/90 |
| 6,870,134 | B2 * | 3/2005 | Sol et al. | 219/203 |

OTHER PUBLICATIONS

European Search Report dated Feb. 13, 2012 issued in corresponding European Patent Application No. 11184106.0.

* cited by examiner

SURFACE HEATING TYPE HEATING UNIT FOR FIXING DEVICE, AND FIXING DEVICE AND IMAGE FORMING APPARATUS INCLUDING THE SAME

CROSS-REFERENCE TO RELATED APPLICATIONS

This application claims the benefit of Korean Patent Application No. 10-2010-0098411, filed on Oct. 8, 2010, and Korean Patent Application No. 10-2011-0006813, filed on Jan. 24, 2011, in the Korean Intellectual Property Office, the disclosures of which are incorporated herein in their entirety by reference.

BACKGROUND

1. Field

The present general inventive concept relates to a heating unit for a fixing device, and a fixing device and an image forming apparatus including the same, and more particularly, to a surface heating type heating unit for a fixing device, and a fixing device and an image forming apparatus including the same.

2. Description of the Related Art

An image forming apparatus, such as a printer, a facsimile, a photocopier, and a multi-function printer, forms a predetermined image on a print media by using an electrophotographic method. Generally, a charging process, an exposing process, a developing process, a transferring process, and a fixing process are performed by the image forming apparatus to form an image. A fixing device used during the fixing process generally applies heat and pressure to a print medium so as to fix un-fixed toner on the print medium.

The fixing device may include a heating unit and a pressurizing unit. A fixing nip contacting the heating unit and the pressurizing unit is formed between the heating unit and the pressurizing unit. When the print medium passes through the fixing nip, heat and pressure are transmitted to the print medium, and thus the un-fixed toner may be fixed. The heating unit includes a heating element so as to transmit the heat to the print medium. A halogen lamp is generally used as the heating element. Since heat generated by the halogen lamp is transmitted to an external surface of the heating unit contacting the print medium through various parts of the heating unit, power consumption and a first paper out time (FPOT) are increased.

Accordingly, a surface heating type fixing device using a planar heating element has been suggested. Here, the planar heating element is disposed directly below the external surface of the heating unit. Since heat generated by the planar heating element is directly transmitted to the print medium, power consumption and FPOT may be decreased.

SUMMARY

The present general inventive concept provides a surface heating type heating unit for a fixing device, wherein an electrode structure and a power feeding structure to supply power to a planar heating element are improved, and a fixing device and an image forming apparatus including the same.

According to an aspect of the present general inventive concept, there is provided a heating unit for a fixing device, the heating unit including: a supporter; a planar heating element disposed on an outer circumferential surface of the supporter; a power feeding terminal disposed on each end of the supporter to be electrically connected to a power source;

and a connector disposed between the planar heating element and the power feeding terminal, wherein the connector includes an adhesive material formed on a first region on the power feeding terminal to adhere the planar heating element and the power feeding terminal to each other, and a conductive material formed on a second region on the power feeding terminal excluding the first region.

The adhesive material may include a primer and the conductive material may include a silver (Ag) paste.

The adhesive material may have a net structure in which a plurality of unit lattices are connected to each other, and the conductive material may be formed inside the plurality of unit lattices. The plurality of unit lattices may have a polygonal or circular shape.

The adhesive material may be formed of a plurality of first lines parallel to each other, the conductive material may be formed of a plurality of second lines parallel to each other, and each of the plurality of second lines may be disposed between two of the plurality of first lines. The plurality of first and second lines may be parallel to each other along a length direction of the heating unit. The plurality of first and second lines may be formed on a plane perpendicular to a length direction of the heating unit. The plurality of first and second lines may be formed in spiral shapes on the power feeding terminal.

The supporter, the planar heating element, the power feeding terminal, and the connector may form a flexible fixing belt. The supporter may be formed of a polyimide film. The planar heating element may be formed by mixing carbon nanotubes in a polymer material. The heating unit may further include a nip forming frame disposed in a region corresponding to a fixing nip inside the heating unit, and pressurizing the heating unit. The region corresponding to the fixing nip, from among a contacting surface wherein the nip forming frame contacts an inner surface of the heating unit may be a flat surface or a fluent curved surface.

The power feeding terminal may be formed of a metallic material or a conductive polymer.

A part of the power feeding terminal may be disposed between the planar heating element and the supporter, and another part of the power feeding terminal may be exposed to be electrically connected to the power source. The heating unit may further include a power feeder for supplying power to the power feeding terminal. The power feeder may include a wire brush or a carbon brush flexibly contacting the power feeding terminal. The power feeder may include a power feeding roller circumscribing the power feeding terminal.

The supporter, the planar heating element, the power feeding terminal, and the connector may form a fixing roller having a cylindrical shape.

The heating unit may further include a protective film formed on the planar heating element to protect the planar heating element.

According to another aspect of the present general inventive concept, there is provided a fixing device including: a heating unit; and a pressurizing unit forming a fixing nip along with the heating unit, wherein the heating unit includes: a supporter; a planar heating element disposed on an outer circumferential surface of the supporter; a power feeding terminal disposed on each end of the supporter to be electrically connected to a power source; and a connector disposed between the planar heating element and the power feeding terminal, wherein the connector includes an adhesive material formed on a first region on the power feeding terminal to adhere the planar heating element and the power feeding terminal to each other, and a conductive material formed on a second region on the power feeding terminal excluding the first region.

According to another aspect of the present general inventive concept, there is provided an image forming apparatus including: a printing unit to transfer a toner image to a print medium by using an electrophotographic method; and a fixing device including a heating unit and a pressurizing unit forming a fixing nip along with the heating unit, which fix the transferred toner image on the print medium, wherein the heating unit includes: a supporter; a planar heating element disposed on an outer circumferential surface of the supporter; a power feeding terminal disposed on each end of the supporter to be electrically connected to a power source; and a connector disposed between the planar heating element and the power feeding terminal, wherein the connector includes an adhesive material formed on a first region on the power feeding terminal to adhere the planar heating element and the power feeding terminal to each other, and a conductive material formed on a second region on the power feeding terminal excluding the first region.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION

Figure 1:
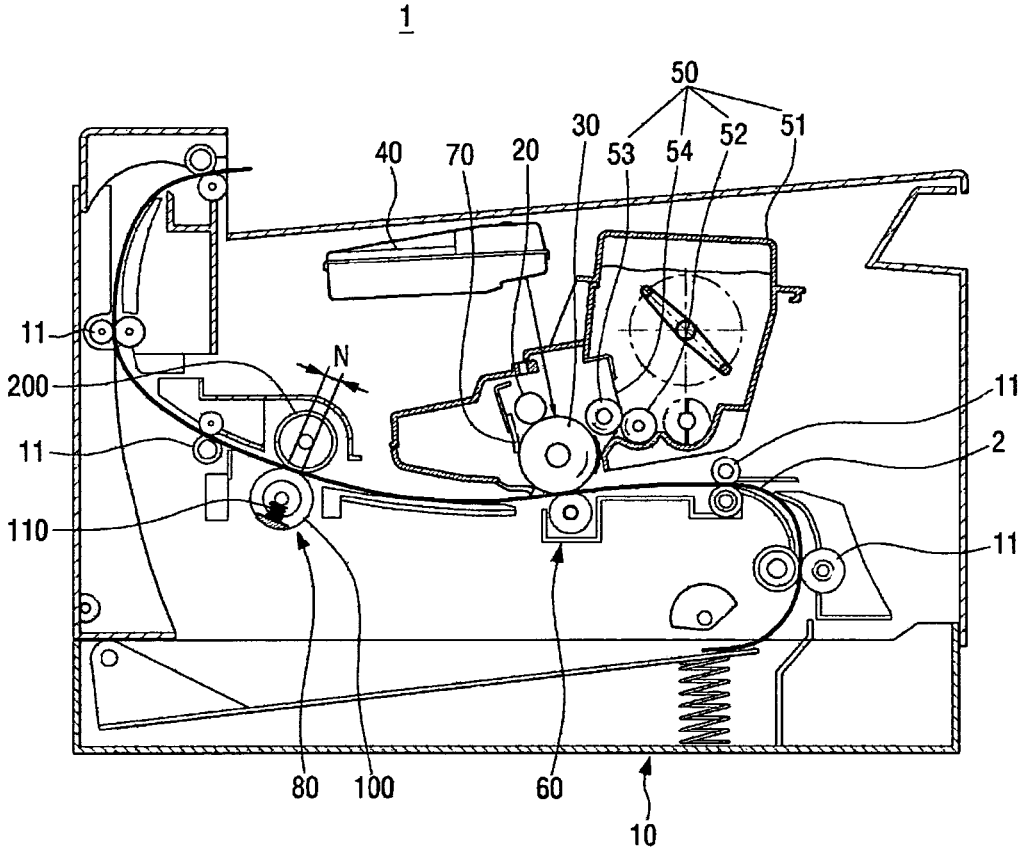
FIG. 1 is a view schematically illustrating an image forming apparatus according to an embodiment of the present disclosure.

The present general inventive concept will now be described more fully with reference to the accompanying drawings, in which exemplary embodiments of the present general inventive concept are shown. In the drawings, like reference numerals denote like elements, and the sizes of elements may be exaggerated for clarity.

FIG. 1 is a view schematically illustrating an image forming apparatus 1 according to an embodiment of the present disclosure. The image forming apparatus 1 may be any device, such as a printer, a facsimile, a photocopier, or a multi-functional printer, which forms a predetermined image on a print medium. A thick full line indicated by a reference numeral 2 in FIG. 1 is a path of a print medium.

A feeder 10 may store a print medium, such as a paper. The print medium is transferred along the path 2 by a plurality of transporting rollers 11. A charging device 20 may charge a photoconductor 30 to predetermined electric potential. An optical scanning device 40 may scan the photoconductor 30 with light so as to form an electrostatic latent image corresponding to print data on the photoconductor 30.

A developing device 50 may form a toner image by supplying toner to the photoconductor 30 on which the electrostatic latent image is formed. The developing device 50 may include a toner storage unit 51, a toner supplying roller 52, a developing roller 53, and a regulating blade 54.

The toner storage unit 51 stores toner therein. The toner supplying roller 52 supplies the toner stored in the toner storage unit 51 to the developing roller 53, and thus a toner layer is formed on the developing roller 53. The regulating blade 54 smoothes the toner layer. The toner layer on the developing roller 53 is transferred to the electrostatic latent image formed on the photoconductor 30 according to a potential difference, to form a toner image.

A transferring device 60 may transfer the toner image formed on the photoconductor 30 to the print medium. A cleaning device 70 may remove toner left on the photoconductor 30 after a transferring process.

A fixing device 80 may fix the toner image transferred to the print medium. The print medium on which the toner image is fixed is discharged outside the image forming apparatus 1 by the transporting rollers 11, and thus a printing process is completed.

The fixing device 80 may include a pressurizing unit 100 and a heating unit 200. A fixing nip N may be formed long in a length direction in a section where the pressurizing unit 100 and the heating unit 200 contact each other. The fixing nip N has the same or larger width than the print medium. The un-fixed toner for forming the toner image exists on the print medium that passed through the transferring device 60, and the un-fixed toner may be fixed on the print medium as heat and pressure are applied to the print medium while the print medium pass through the fixing nip N.

The pressurizing unit 100 may be formed of an elastic material, such as rubber or sponge. The pressurizing unit 100 may apply pressure to the print medium passing through the fixing nip N. For example, a spring 110 may pressurize the pressurizing unit 100 to the heating unit 200. The pressurizing unit 100 may rotate by a driving device (not shown) included in the image forming apparatus 1. In the current embodiment, the pressurizing unit 100 is a roller type, but alternatively, the pressurizing unit 100 may be a belt type. In other words, the type of the pressurizing unit 100 is not limited as long as the pressurizing unit 100 applies pressure to the print medium passing through the fixing nip N.

Figure 2:
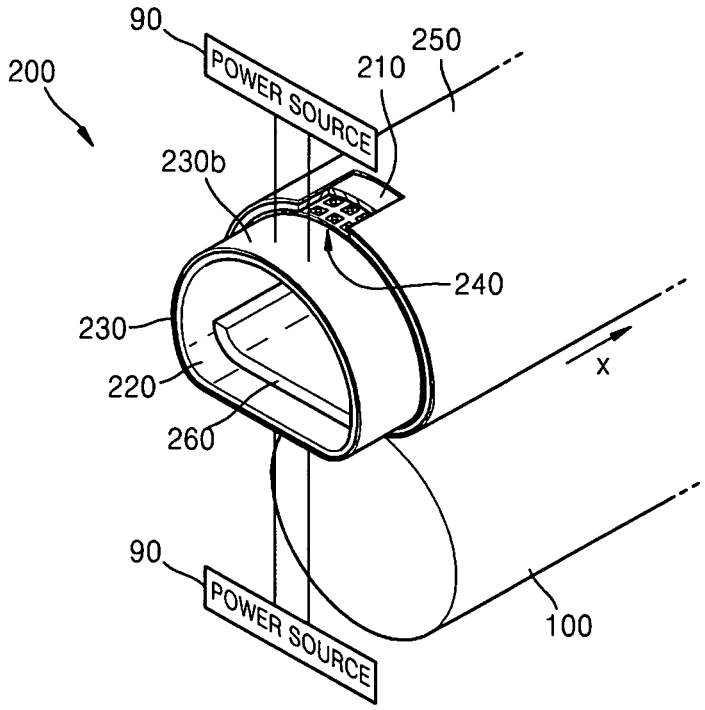
FIG. 2 is a magnified cross-sectional perspective view of a fixing device of FIG. 1.
Figure 3:
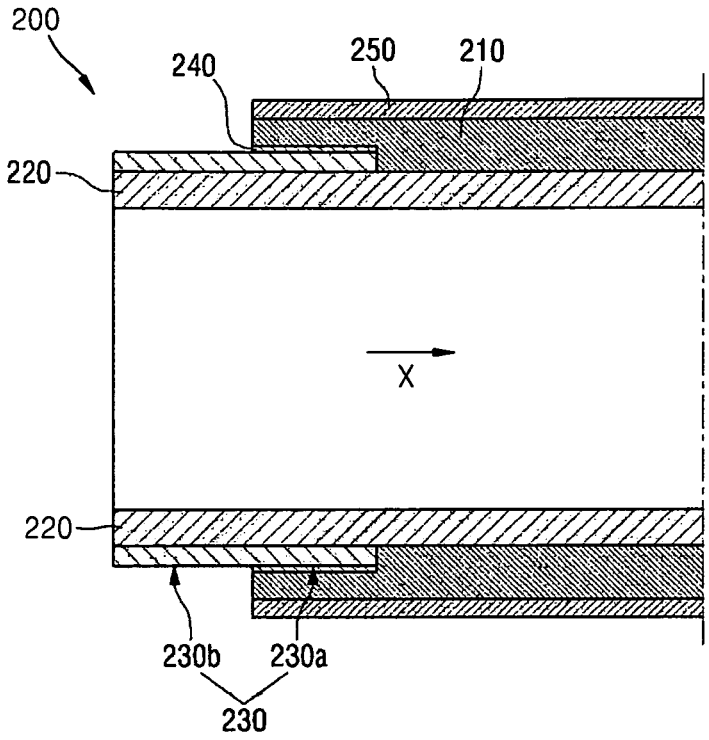
FIG. 3 is a schematic cross-sectional view of a length direction of a heating unit of the fixing device of FIG. 2.

The heating unit 200 may apply heat to the print medium passing through the fixing nip N. FIG. 2 is a magnified view of the heating unit 200 of FIG. 1, and FIG. 3 is a cross-sectional view cut along a length direction X of the heating unit 200. The heating unit 200 will now be described in detail with reference to FIGS. 2 and 3. In FIG. 2, parts of a protective film 250 and a planar heating element 210 are cut so that a connector 240 is shown.

The heating unit 200 includes the planar heating element 210 a supporter 220, a power feeding terminal 230, the connector 240, and the protective film 250. The planar heating element 210, the supporter 220, the power feeding terminal 230, the connector 240, and the protective film 250 may form a fixing belt having a closed loop shape and flexibility. In other words, the planar heating element 210, the supporter 220, the power feeding terminal 230, the connector 240, and the protective film 250 may be formed of a film having flexibility and a tube shape to form a fixing belt in overall. In detail, the heating unit 200 of the current embodiment is a belt type, and is put on a nip forming frame 260 tensionlessly. As the pressurizing unit 100 rotates, the heating unit 200 may rotate according to frictional force between the pressurizing unit 100 and the heating unit 200. Accordingly, the print medium that passed through the transferring device 60 may pass through the fixing nip N.

The planar heating element 210 may have the same or wider width than the print medium. Also, the planar heating element 210 may be formed on the supporter 220, in a thickness from 100 to 500 μm. The planar heating element 210 has electric resistance, and thus may generate Joule's heat when power is supplied from a power source 90. The power source 90 may be a common power source of the image forming apparatus 1, or a power source separately prepared for the fixing device 80. The planar heating element 210 may be formed by mixing carbon nanotubes or metal particles with a polymer material. Here, the polymer material may be a resin, silicon, a polymer, or a material similar thereto. However, the planar heating element 210 may be formed differently. For example, carbon nanotubes have excellent electric conductivity and mechanical properties, and thus carbon nanotubes may be dispersed in silicon rubber to form the planar heating element 210, thereby obtaining uniform heating and reliability at a high temperature.

The supporter 220 is formed to have a wider width than the planar heating element 210. The supporter 220 may be disposed below the planar heating element 210 to support the planar heating element 210. Each end of the supporter 220 is exposed from the planar heating element 210. The supporter 220 may be formed of a polyimide film having thermal resistance and an electric insulating property. Since the supporter 220 operates as a supporter having a belt shape, a thickness of the supporter 220 may be decreased to decrease thermal capacity. Accordingly, heat lost to the supporter 220, from among heat generated by the planar heating element 210 may be decreased, and most heat generated by the planar heating element 210 may be used for fixing. As such, the fixing device 80 according to the current embodiment may have high energy efficiency and an excellent heating rate by using the heating unit 200 having the belt type and the planar heating element 210.

The power feeding terminal 230 may be electrically connected to the power source 90. A power feeding structure of the power source 90 and the power feeding terminal 230 will be described in detail later.

As shown in FIG. 2, the power feeding terminal is formed on one end of the supporter 220. Another power feeding terminal is not shown since only one end of the heating unit 200 is shown in FIG. 2, but the power feeding terminal 230 may also be formed on another end of the supporter 220. As shown in FIG. 3, a part 230*a* of the power feeding terminal 230 is disposed between the planar heating element 210 and the supporter 220, and another part 230*b* may be exposed to be electrically connected to the power source 90. The power feeding terminal 230 may be formed of a conductive material, for example, a metallic material such as copper (Cu) or nickel (Ni), or a conductive polymer. The power feeding terminal 230 may be formed by using any method, such as a deposition method, a plating method, or a sputtering method. For example, a seed layer for plating may be formed on a region where the power feeding terminal 230 is to be formed via sputtering of physical vapor deposition (PVD), and the power feeding terminal 230 may be formed by using a plating process. For good adhesiveness, the region may be plasma-etched so as to increase surface roughness, or a predetermined metal ion may be formed on a surface of the region.

The connector 240 may be electrically connected to the power feeding terminal 230 to supply power to the planar heating element 210. As shown in FIG. 3, the connector may be formed between the planar heating element 210 and the power feeding terminal 230.

The protective film 250 may be formed on the planar heating element 210 to protect the planar heating element 210. The protective film 250 may be heterogeneous to the toner so as to prevent the toner from being adhered on a surface of the heating unit 200. For example, the protective film 250 may be formed of silicon rubber, fluorine rubber, or fluorine resin. A thickness of the protective film 250 may be from 1 μm to 50 μm.

In the heating unit 200 according to the current embodiment, the planar heating element 210, the supporter 220, the power feeding terminal 230, the connector 240, and the protective film 250 form a fixing belt, and integrally rotate. Alternatively, a heating unit 800 having a roller type shown in FIG. 15 may be used. The heating unit 800 having the roller type will be described in detail later with reference to FIG. 15.

Since the supporter 220 for supporting the belt shape has a relatively low rigidity, the nip forming frame 260 for enduring the pressure applied by the pressurizing unit 100 is separately disposed in a region inside the heating unit 200 corresponding to the fixing nip N. A contacting surface of the nip forming frame 260 contacting an inner surface of the heating unit 200, specifically the region corresponding to the fixing nip N may be a flat surface or a fluent curved surface. In the heating unit 200 in such a belt type, the fixing belt including the planar heating element 210, the supporter 220, the power feeding terminal 230, the connector 240, and the protective film 250 rotates according to the frictional force as the pressurizing unit 100 rotates, and the nip forming frame 260 is fixed. A region of the fixing nip N of the heating unit 200 is flat or fluently curved by the nip forming frame 260, and thus the fixing nip N by the heating unit 200 and the pressurizing unit 100 is widely formed, thereby improving fixing efficiency. Further, the flat or fluently curved surface of the nip forming frame 260 prevents the print medium from deforming in a fixing section, and thus a curl phenomenon, in which the print medium is deformed in a direction of the heating unit 200, or a wrap jam phenomenon, in which the print medium is wrapped around the heating unit 200, is prevented.

The power generated by the power source 90 is supplied to the planar heating element 210 through the power feeding terminal 230 and the connector 240. The heat generated by the planar heating element 210 adjacently disposed to the print medium passing through the fixing nip N is directly transmitted to the print medium, and thus power consumption and FPOT may be decreased. In order to prevent electric leakage, the protective film 250 surrounding the planar heating element 210, and the supporter 220 may have electric insulating properties. Alternatively, if the supporter 220 is formed of a material that does not have an electric insulating property, an electric insulating layer may be formed between the supporter 220 and the planar heating element 210.

Figure 4:
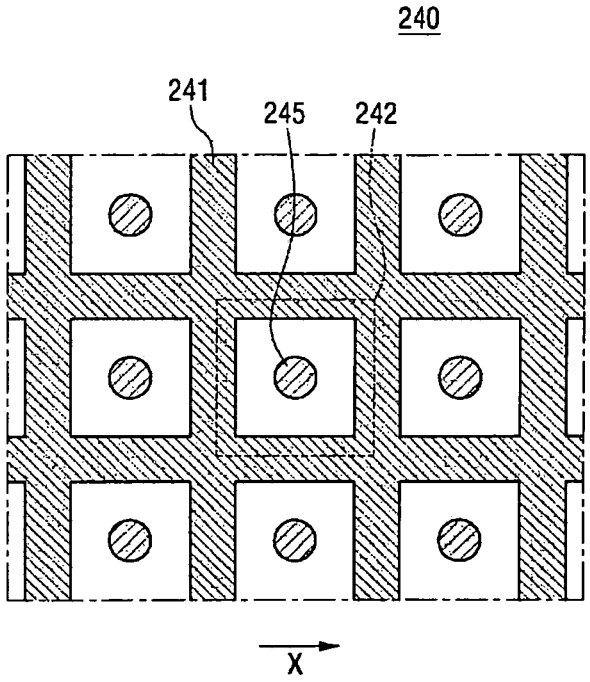
FIG. 4 is a magnified view of a part of a connector of FIG. 2.

FIG. 4 is a magnified view of a part of the connector 240 of FIG. 2. The connector 240 will now be described in detail with reference to FIG. 4. The connector 240 is formed on the power feeding terminal 230 having a flexible tube shape, and for convenience of description, FIG. 4 shows the connector 240 spread out on the ground.

The connector 240 includes an adhesive material 241 and a conductive material 245, which are formed on the power feeding terminal 230. The adhesive material 241 may be a primer and the conductive material 245 may be a silver (Ag) paste.

The adhesive material 241 and the conductive material 245 do not overlap on each other. In other words, a region where the adhesive material 241 is formed and a region where the conductive material 245 is formed are separated from each other. For example, as shown in FIG. 4, the adhesive material 241 may have a net structure in which a plurality of unit lattices 242 are connected to each other, and the conductive material 245 may be formed inside the unit lattice 242. For convenience of description, FIG. 4 only illustrates one unit lattice 242.

The adhesive material 241 and the conductive material 245 may be formed by using a screen process, or the like. The adhesive material 241 may be formed first, and then the conductive material 245 may be formed, or vice versa. Since a process error is generated in reality, the adhesive material 241 and the conductive material 245 may be formed in such a way that a small space exists between the adhesive material 241 and the conductive material 245, as shown in FIG. 4. When a technology develops, a space between the adhesive material 241 and the conductive material 245 may be decreased.

A contact resistance exists between the planar heating element 210 and the connector 240, and between the connector 240 and the power feeding terminal 230. The contact resistance means electric resistance generated on a contacting surface of two conductors when a current flows through the contacting surface. The contact resistance difference according to a type of conductor, contact pressure, existence of an oxide film, current density, etc. The contact resistance may be reduced so as to reduce the power consumption and FPOT.

In the current embodiment, the contact resistance may be reduced by forming the connector 240 of two different types of materials, i.e., the adhesive material 241 and conductive material 245, which perform different functions. In other words, since the planar heating element 210 and the power feeding terminal 230 are strongly adhered to the connector 240 by the adhesive material 241, contact pressures between the planar heating element 210 and the connector 240, and between the connector 240 and the power feeding terminal 230 may be increased. For example, when the adhesive material 241 is formed of primer, the primer contracts during a hardening process, and thus the contact pressures between the planar heating element 210 and the connector 240, and between the connector 240 and the power feeding terminal 230 are increased. On the other hand, the conductive material 245 may be formed of a material having low electric resistance, for example, an Ag paste, so as to reduce the contact resistance. For reference, the Ag paste has low specific resistance of 15.87 μnΩ·m. As such, the adhesive material 241 increases the contact pressure, and the conductive material 245 decreases the electric resistance, thereby decreasing the contact resistance.

Also, since the planar heating element 210 and the power feeding terminal 230 has a flexible belt shape, durability is required in the connection between the planar heating element 210 and the power feeding terminal 230. In the current embodiment, the durability in the connection between the planar heating element 210 and the power feeding terminal 230 is obtained since the connector 240 is formed of two different materials, i.e., the adhesive material 241 and the conductive material 245, which perform different functions. In other words, the adhesive material 241 stably adheres the planar heating element 210 and the power feeding terminal 230 to the connector 240, even if the planar heating element 210 becomes flat due to mechanical shock or pressure of the pressurizing unit 100. Moreover, when the planar heating element 210 is formed by, for example, dispersing the carbon nanotubes in the silicon rubber, a contacting property of the planar heating element 210 to another conductive material is not good, and thus the adhesive material 241 is used to obtain stable adhesion.

Specifically, since the adhesive material 241 has the net structure as shown in FIG. 4, the adhesion of the planar heating element 210 and the power feeding terminal 230 to the connector 240 may be increased. The unit lattice 242 in FIG. 4 has a rectangular shape, but the unit lattice 242 may be another polygonal shape, such as a triangular shape, a hexagonal shape, or an octagonal shape. Alternatively, the unit lattice 242 may have a circular shape.

In the above embodiment, the adhesive material 241 is formed of the primer, but the adhesive material 241 may be formed of any material for adhering the planar heating element 210 and the power feeding terminal 230 to the connector 240. Also, in the above embodiment, the conductive material 245 is formed of the Ag paste, but the conductive material 245 may be formed of a material having a similar specific resistance as the Ag paste.

Figure 5:
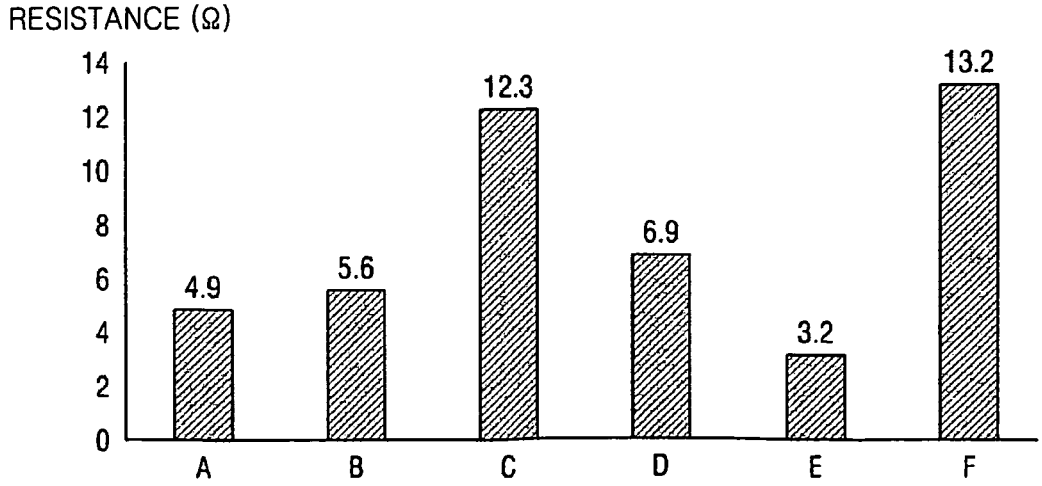
FIG. 5 is a graph for comparing entire electric resistance of a heating unit according to an embodiment of the present disclosure, and entire electric resistances of heating units having electrode structures different from the heating unit of the current embodiment.

FIG. 5 is a graph for comparing entire electric resistance of the heating unit 200 according to the current embodiment, and entire electric resistances of heating units having electrode structures different from the heating unit 200. Here, the entire electric resistance is obtained by adding all electric resistances of the power feeding terminal 230, the connector 240, and the planar heating element 210, through which a current passes. In each heating unit, diameters and shapes of the planar heating elements 210 are the same.

In FIG. 5, a case A corresponds to the current embodiment, wherein the adhesive material 241 is formed of a primer, and the conductive material 245 is formed of an Ag paste. In a case B, an electrode structure is only formed of an Ag paste. In case C, an electrode structure is formed by adhering a pin to a side of the planar heating element 210, and soldering the pin. In a case D, an electrode structure is formed by stamping a metal to the planar heating element 210. In case E, an electrode structure is formed only via soldering. In case F, an electrode structure is formed by only using a conductive primer.

The entire electric resistance of the current embodiment is 4.9Ω, which is lower than the entire electric resistances of the cases B, C, D, and F. Specifically, the entire electric resistance of the current embodiment is lower than the entire electric resistance (5.6Ω) of the case B, wherein the electrode structure is only formed of the Ag paste having low specific resistance. This is because, as described above, the primer considerably decreased the contact resistance by increasing the contact pressures between the planar heating element 210 and the connector 240, and between the connector 240 and the power feeding terminal 230. Also, the case B is not mass-produceable. This is because the Ag paste is easily damaged due to deformation of the planar heating element 210 according to a mechanical shock or pressure applied to the planar heating element 210 by the pressurizing unit 100.

The case E, wherein the electrode structure is only formed via soldering, has the entire electric resistance lower than the current embodiment, but the case E is also not mass-produceable. This is also because the soldering is easily damaged due to deformation of the planar heating element 210 according to a mechanical shock or pressure applied to the planar heating element 210 by the pressurizing unit 100. Accordingly, the case E is unable to be applied to an actual fixing device.

The case F, wherein the electrode structure is only formed of the conductive primer, has relatively high entire electric resistance, because the conductive primer known up to now has conductivity but has relatively high specific resistance compared to an Ag paste.

Referring to FIG. 5, by forming the connector 240 with two different types of materials, i.e., the adhesive material 241 and the conductive material 245, performing different functions, the entire electric resistance of the heating unit 200 is decreased, and the planar heating element 210 and the power feeding terminal 230 are stably connected to the connector 240.

FIGS. 6 through 9 are schematic views of connectors 240 according to other embodiments, wherein a part of each connector 240 is magnified as in FIG. 4. In the connectors 240 of FIGS. 6 through 9, the adhesive material 241 and the conductive material 245 are differently disposed.

Figure 6:
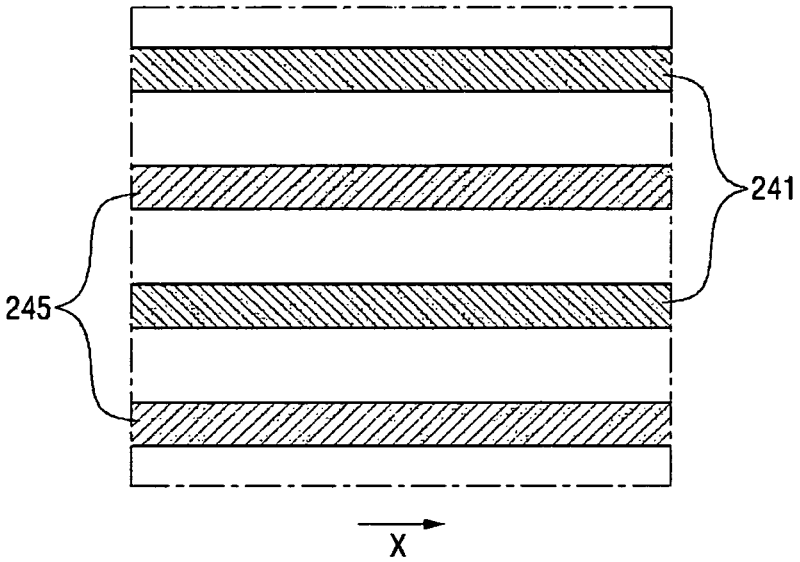
FIGS. 6 through 9 are schematic views of connectors according to other embodiments.

Referring to FIG. 6, the adhesive material 241 is formed in a plurality of first lines parallel to each other. The conductive material 245 is formed in a plurality of second lines parallel to each other, wherein each of the second lines are disposed between the two first lines. Here, the first and second lines are parallel to the length direction X of the heating unit 200.

Figure 7:
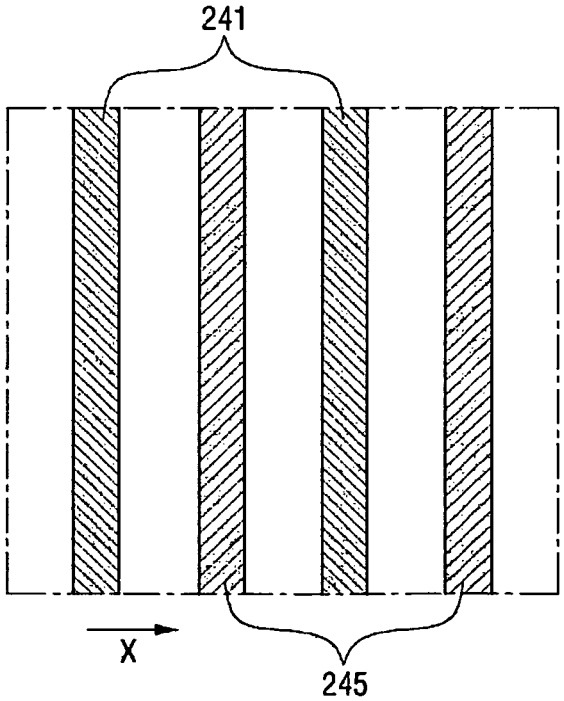

The arrangement of the adhesive material 241 and the conductive material 245 in FIG. 7 is similar to that of FIG. 6, except that the first and second lines are formed on a plane perpendicular to the length direction X of the heating unit 200. 3-dimensionally, the adhesive material 241 and the conductive material 245 of FIG. 7 have a circular shape on the power feeding terminal 230.

Figure 8:
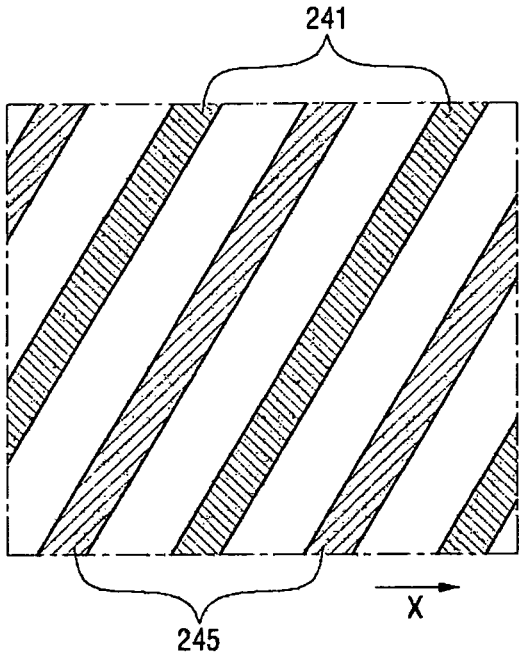

The arrangement of the adhesive material 241 and the conductive material 245 in FIG. 8 is similar to that of FIG. 6, except that the first and second lines incline with respect to the length direction X of the heating unit 200. 3-dimensionally, the adhesive material 241 and the conductive material 245 of FIG. 8 have a spiral shape on the power feeding terminal 230.

Figure 9:
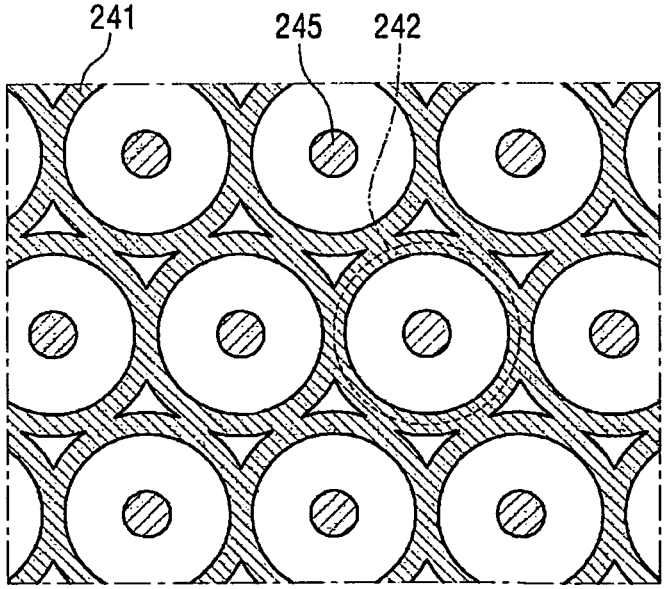

The arrangement of the adhesive material 241 and the conductive material 245 in FIG. 9 is similar to that of FIG. 4, except that the unit lattices 242 forming the net structure of the adhesive material 241 have circular shapes. The conductive material 245 is formed inside the unit lattice 242 having the circular shape.

An electric connection structure, i.e., a power feeding structure, of the power feeding terminal 230 and the power source 90 will now be described with reference to FIG. 10.

Figure 10:
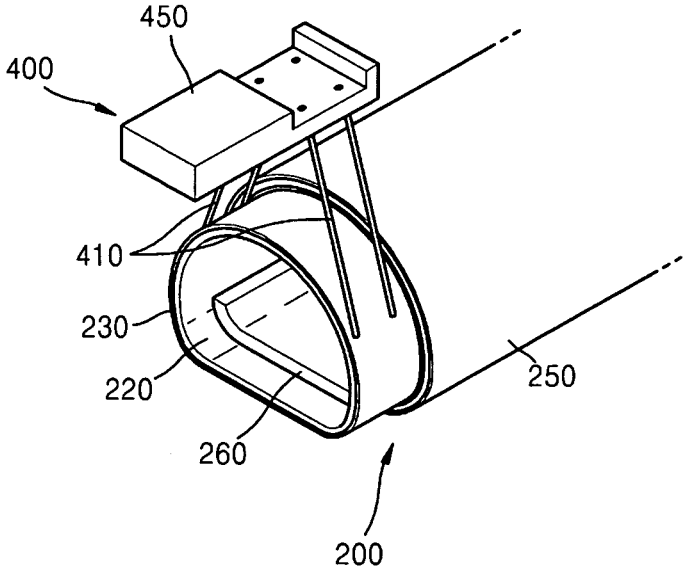
FIG. 10 is a view of a power feeding structure of the heating unit of the fixing device of FIG. 2, according to an embodiment of the present disclosure.

Referring to FIG. 10, the heating unit 200 may employ a power feeding structure using a wire brush method. In other words, a power feeder 400 may include a wire brush 410, which elastically contacts the exposed power feeding terminal 230 of the heating unit 200, and a supporter 450 to support the wire brush 410. The wire brush feeds power by contacting the rotating heating unit 200, and may be formed of an Ag-based alloy. Further, the exposed other part 230*b* of the power feeding terminal 230 of the heating unit 200 may be plated with a metal having low friction so as to reduce friction with the wire brush 410. As described above, since the heating unit 200 of the current embodiment is a belt type, the heating unit 200 does not have any tension. Accordingly, since elastic pressure of the wire brush 410 to the heating unit 200 may partially deform each end of the heating unit 200, the elastic pressure of the wire brush 410 may be determined in such a way that the deformation of each end of the heating unit 200 is minimized.

Figure 11:
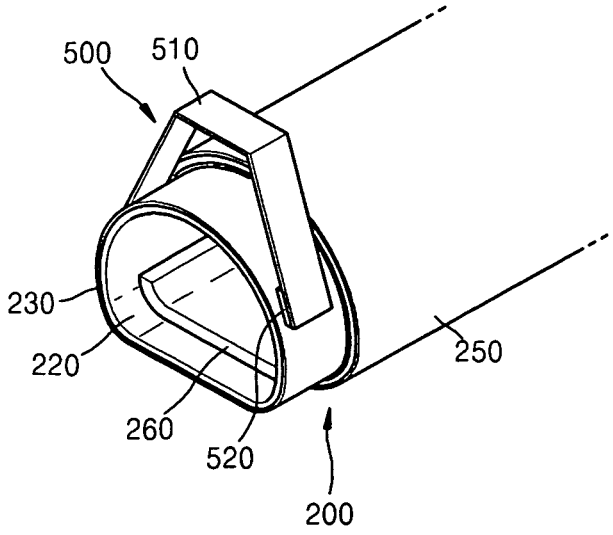
FIG. 11 is a view of a power feeding structure of the heating unit of the fixing device of FIG. 2, according to another embodiment of the present disclosure.

FIG. 11 is a view of a power feeding structure of the heating unit 200, according to another embodiment of the present general inventive concept. Referring to FIG. 11, the heating unit 200 of the current embodiment may employ a power feeding structure using a carbon brush method. In other words, a power feeder 500 may include a carbon brush 520, which elastically contacts the exposed power feeding terminal 230 of the heating unit 200, and a plate spring 510, which elastically supports the carbon brush 520. The carbon brush 520 has good conductivity and a small coefficient of friction with a metal. Further, since the carbon brush 520 may have a predetermined thickness, a power feeding operation may be stably performed since uniform pressure is maintained by the plate spring 510 even if the carbon brush 420 is worn out.

Figure 12:
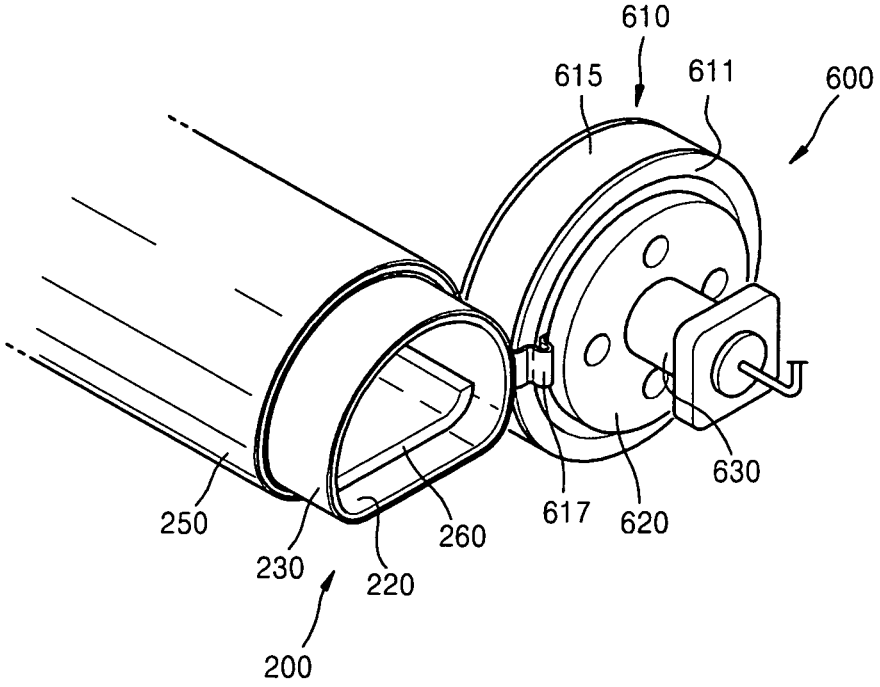
FIG. 12 is a view of a power feeding structure of the heating unit of the fixing device of FIG. 2, according to another embodiment of the present disclosure.

FIG. 12 is a view of a power feeding structure of the heating unit 200, according to another embodiment of the present general inventive concept. Referring to FIG. 12, the heating unit 200 may employ a power feeding structure using a power feeding roller method. In other words, a power feeder 600 may include a power feeding roller 610 elastically contacting the power feeding terminal 230 exposed at each end of the heating unit 200. The power feeding roller 610 includes a supporting wheel 611 having a wheel shape, and a ring electrode 615 disposed on an outer circumference surface of the supporting wheel 611. The supporting wheel 611 may be formed of an elastic material, such as silicon rubber, so that the ring electrode 615 rolling-contacts the heating unit 200. In other words, the power feeding roller 610 rotates with the heating unit 200 by rolling-contacting the heating unit 200. A part 617 of the ring electrode 615 extends to the outside of the outer circumferential surface of the supporting wheel 611, thereby electrically contacting supporters 620 and 630 supporting the power feeding roller 610, and connecting to the power source 90 of FIG. 2.

Figure 13:
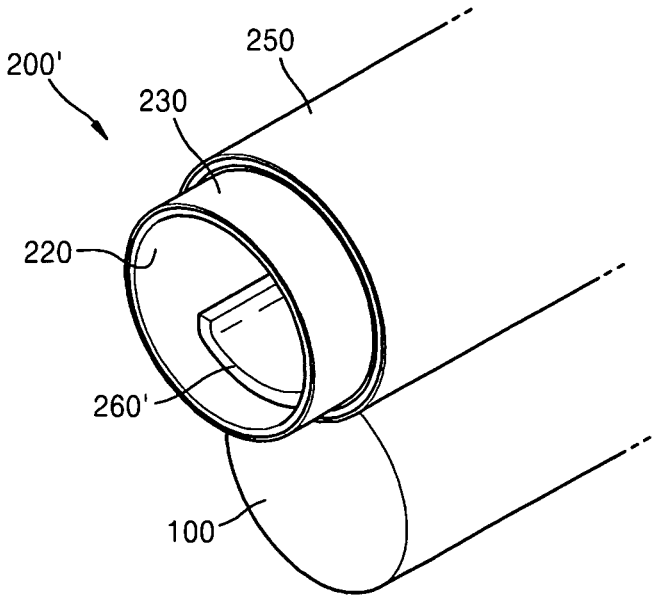
FIG. 13 is a schematic perspective view of a heating unit according to another embodiment of the present disclosure.
Figure 14:
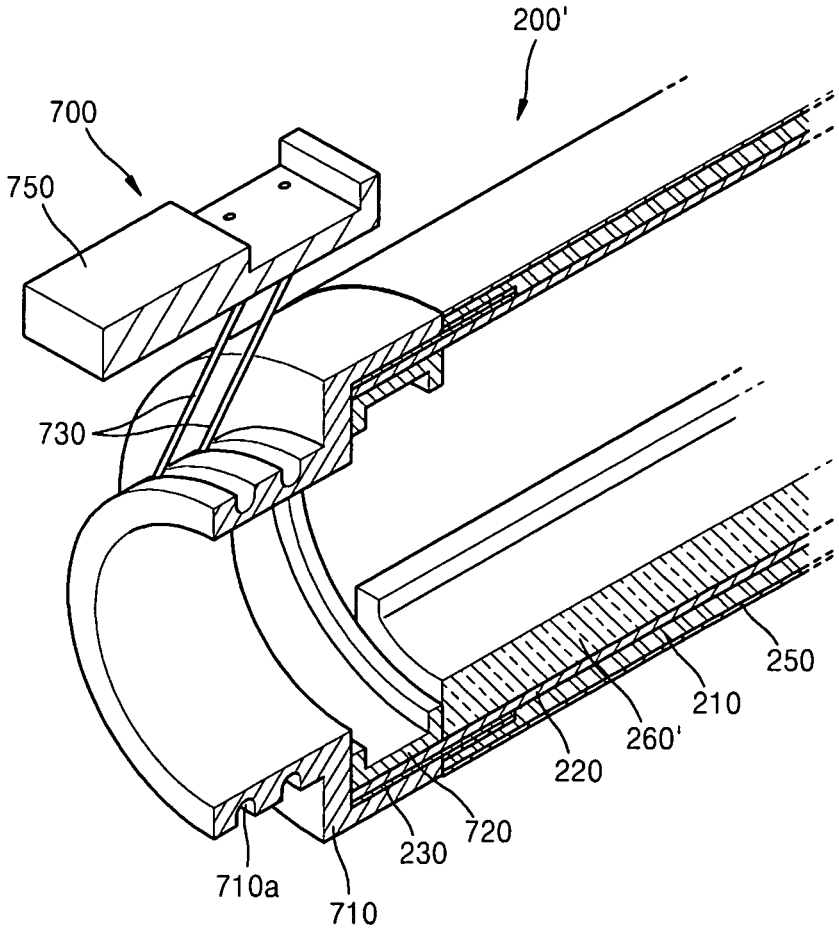
FIG. 14 is a view of a power feeding structure of the heating unit of a fixing device of FIG. 13, according to an embodiment of the present disclosure.

FIG. 13 is a schematic perspective view of a heating unit 200' according to another embodiment of the present general inventive concept, and FIG. 14 is a view of a power feeding structure of the heating unit 200'.

In FIGS. 2 and 10 through 12, the contacting surface of the nip forming frame 260 contacting the inner surface of the heating unit 200 is a flat surface or a fluently curved surface, but the contacting surface is not limited thereto. Referring to FIG. 13, a contacting surface of a nip forming frame 260' contacting an inner surface of the heating unit 200' may be a semicylindrical surface. Here, the heating unit 200' in a belt type forms a semicylindrical fixing nip, and rotates in a cylindrical shape as the pressurizing unit 100 rotates.

Meanwhile, a power feeder 700 may include first and second connectors 710 and 720, which maintain a cylindrical shape of the heating unit 200', a wire brush 730, which elastically contacts the first connector 710, and a supporter 750, which supports the wire brush 730. The first connector 710 is formed of a conductive material such as a metal, and has an inner circumferential surface of a cylindrical shape, thereby contacting the exposed outer circumferential surface of the power feeding terminal 230 disposed at each end of the heating unit 200'. The second connector 720 has an outer circumferential surface having a cylindrical shape, and supports the heating unit 200' at the inner circumferential surface of the heating unit 200'. The first and second connectors 710 and 720 engage the inside and outside of the each end of the heating unit 200' having the belt shape, and thus rotate with the heating unit 200'.

As described above, since the heating unit 200' of the current embodiment is the belt type, the heating unit 200' does not have any tension. Accordingly, elastic pressure for feeding power may adversely affect the durability by partially deforming each end of the heating unit 200'. However, the heating unit 200' of the current embodiment maintains the belt shape while driven, and the power feeder 700 maintains the cylindrical shape of the heating unit 200', thereby suppressing the deformation of the heating unit 200'.

Meanwhile, a circular guide groove 710*a* is disposed on the outer circumferential surface of the first connector 710 to contact the wire brush 730, so that the wire brush 730 stably contacts the first connector 710.

The power feeding structure of the heating unit 200' is not limited thereto, and any of the power feeding structure described with reference to FIGS. 10 through 12 may be employed.

Figure 15:
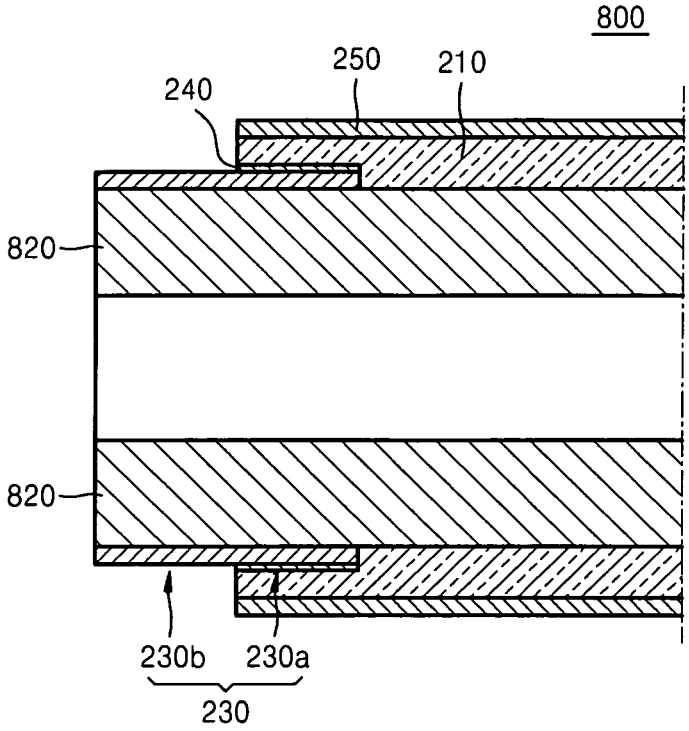
FIG. 15 is a schematic cross-sectional view of a length direction of a heating unit, according to another embodiment of the present disclosure.

FIG. 15 is a schematic cross-sectional view of the length direction X of the heating unit 800, according to another embodiment of the present disclosure. The same reference numerals are given to elements performing the same functions as the above embodiments, and details thereof will not be repeated.

The heating units 200 and 200' described above are the belt types, but the heating unit 800 of FIG. 15 is a roller type. Referring to FIG. 15, a supporter 820, the planar heating element 210, and the protective film 250 form a fixing roller. Here, the supporter 820 forming a part of the fixing roller may have rigidity equal to or above the pressure applied by the pressurizing unit 100. For example, the supporter 820 may be formed of a metal, such as iron, steel, stainless steel, aluminum, or copper, plastic having excellent mechanical characteristics and thermal resistance even at a high temperature, ceramic, or glass.

Since the heating unit 800 of FIG. 15 has the same connector 240 as described above, the entire electric resistance of the heating unit 800 is decreased and the planar heating element 210 and the power feeding terminal 230 are stably connected to the connector 240. Moreover, the power feeding terminal 230 is exposed at each end of the heating unit 800 of FIG. 15, and may have the same power feeding structure described above.

Since the surface heating type heating unit for a fixing device, and the fixing device and the image forming apparatus including the same employ the planar heating element described in the above embodiments, the energy efficiency and the heating rate are high, electrical and mechanical contact between the planar heating element and the power feeding terminal are increased, and electrical and mechanical contact between the heating unit and the power feeder are increased.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A heating unit for a fixing device, the heating unit comprising:

a supporter;

a planar heating element disposed on an outer circumferential surface of the supporter;

a power feeding terminal disposed on each end of the supporter to be electrically connected to a power source; and a connector disposed between the planar heating element and the power feeding terminal, wherein the connector comprises an adhesive material formed on a first region on the power feeding terminal to adhere the planar heating element and the power feeding terminal to each other, and a conductive material formed on a second region on the power feeding terminal excluding the first region, wherein the adhesive material has a net structure in which a plurality of unit lattices are connected to each other, and the conductive material is formed inside the plurality of unit lattices, and wherein the plurality of unit lattices have a polygonal or circular shape.

2. The heating unit of claim 1, wherein the adhesive material comprises a primer and the conductive material comprises a silver (Ag) paste.

3. The heating unit of claim 1, wherein the supporter, the planar heating element, the power feeding terminal, and the connector form a fixing roller having a cylindrical shape.

4. The heating unit of claim 1, further comprising a protective film formed on the planar heating element to protect the planar heating element.

5. A fixing device comprising:

a heating unit according to claim 1; and a pressurizing unit forming a fixing nip along with the heating unit.

6. An image forming apparatus comprising:

a printing unit to transfer a toner image to a print medium by using an electrophotographic method; and a fixing device comprising a heating unit according to claim 1 and a pressurizing unit forming a fixing nip along with the heating unit, which fix the transferred toner image on the print medium.

7. A heating unit for a fixing device, the heating unit comprising:

a supporter;

a planar heating element disposed on an outer circumferential surface of the supporter;

a power feeding terminal disposed on each end of the supporter to be electrically connected to a power source; and a connector disposed between the planar heating element and the power feeding terminal, wherein the connector comprises an adhesive material formed on a first region on the power feeding terminal to adhere the planar heating element and the power feeding terminal to each other, and a conductive material formed on a second region on the power feeding terminal excluding the first region, and wherein the adhesive material is formed of a plurality of first lines parallel to each other, the conductive material is formed of a plurality of second lines parallel to each other, and each of the plurality of second lines is disposed between two of the plurality of first lines, the plurality of first and second lines being formed in spiral shapes on the power feeding terminal.

8. The heating unit of claim 7, wherein the plurality of first and second lines are parallel to each other along a length direction of the heating unit.

9. The heating unit of claim 7, wherein the plurality of first and second lines are formed on a plane perpendicular to a length direction of the heating unit.

10. A fixing device comprising:

a heating unit according to claim 7; and a pressurizing unit forming a fixing nip along with the heating unit.

11. An image forming apparatus comprising:

a printing unit to transfer a toner image to a print medium by using an electrophotographic method; and a fixing device comprising a heating unit according to claim 7 and a pressurizing unit forming a fixing nip along with the heating unit, which fix the transferred toner image on the print medium.

12. A heating unit for a fixing device, the heating unit comprising:

a supporter;

a planar heating element disposed on an outer circumferential surface of the supporter;

a power feeding terminal disposed on each end of the supporter to be electrically connected to a power source; and a connector disposed between the planar heating element and the power feeding terminal, wherein the connector comprises an adhesive material formed on a first region on the power feeding terminal to adhere the planar heating element and the power feeding terminal to each other, and a conductive material formed on a second region on the power feeding terminal excluding the first region, wherein the supporter, the planar heating element, the power feeding terminal, and the connector form a flexible fixing belt, and wherein a part of the power feeding terminal is disposed between the planar heating element and the supporter, and another part of the power feeding terminal is exposed to be electrically connected to the power source.

13. The heating unit of claim 12, wherein the supporter is formed of a polyimide film.

14. The heating unit of claim 12, further comprising a nip forming frame disposed in a region corresponding to a fixing nip inside the heating unit, and pressurizing the heating unit.

15. The heating unit of claim 14, wherein the region corresponding to the fixing nip, from among a contacting surface wherein the nip forming frame contacts an inner surface of the heating unit, is a flat surface or a fluent curved surface.

16. The heating unit of claim 14, wherein the region corresponding to the fixing nip, from among a contacting surface wherein the nip forming frame contacts an inner surface of the heating unit, is a semicylindrical surface.

17. The heating unit of claim 12, wherein the power feeding terminal is formed of a metallic material or a conductive polymer.

18. The heating unit of claim 12, further comprising a power feeder to supply power to the power feeding terminal.

19. The heating unit of claim 18, wherein the power feeder comprises a wire brush or a carbon brush flexibly contacting the power feeding terminal.

20. The heating unit of claim 18, wherein the power feeder comprises a power feeding roller circumscribing the power feeding terminal.

21. A fixing device comprising:

a heating unit according to claim 12; and a pressurizing unit forming a fixing nip along with the heating unit.

22. An image forming apparatus comprising:

a printing unit to transfer a toner image to a print medium by using an electrophotographic method; and a fixing device comprising a heating unit according to claim 12 and a pressurizing unit forming a fixing nip along with the heating unit, which fix the transferred toner image on the print medium.

23. A heating unit for a fixing device, the heating unit comprising:

a supporter;

a planar heating element disposed on an outer circumferential surface of the supporter;

a power feeding terminal disposed on each end of the supporter to be electrically connected to a power source; and a connector disposed between the planar heating element and the power feeding terminal, wherein the connector comprises an adhesive material formed on a first region on the power feeding terminal to adhere the planar heating element and the power feeding terminal to each other, and a conductive material formed on a second region on the power feeding terminal excluding the first region, wherein the supporter, the planar heating element, the power feeding terminal, and the connector form a flexible fixing belt, and wherein the planar heating element is formed by mixing carbon nanotubes in a polymer material.

* * * * *